US006748717B2

(12) United States Patent
Sumner, Sr.

(10) Patent No.: US 6,748,717 B2
(45) Date of Patent: Jun. 15, 2004

(54) METHOD AND SYSTEM FOR EMPLACING PREFABRICATED BUILDINGS

(76) Inventor: John Eugene Sumner, Sr., 2107 Pleasant Ridge Rd., Greensboro, NC (US) 27410

( * ) Notice: Subject to any disclaimer, the term of this patent is extended or adjusted under 35 U.S.C. 154(b) by 56 days.

(21) Appl. No.: 10/166,830

(22) Filed: Jun. 11, 2002

(65) Prior Publication Data

US 2002/0148174 A1 Oct. 17, 2002

Related U.S. Application Data

(63) Continuation-in-part of application No. 09/710,778, filed on Nov. 9, 2000, now Pat. No. 6,568,147.

(51) Int. Cl.[7] ..... E02D 5/74; E02D 5/76; E02D 13/08

(52) U.S. Cl. ..... 52/745.12; 52/741.14; 52/741.15; 52/169.9; 52/DIG. 11; 249/65

(58) Field of Search ..... 52/741.14, 741.15, 52/741.11, 742.1, 742.13, 742.14, 745.21, 169.13; 249/65; 405/216, 243, 257

(56) References Cited

U.S. PATENT DOCUMENTS

| | | | | | |
|---|---|---|---|---|---|
| 1,848,246 | A | * | 3/1932 | Dowell | 52/741.13 |
| 2,138,958 | A | * | 12/1938 | Corbett et al. | 52/169.9 |
| 2,780,935 | A | * | 2/1957 | Rumble | 52/741.13 |
| 3,276,176 | A | * | 10/1966 | Joensson et al. | 249/65 |
| 3,282,001 | A | * | 11/1966 | Bigalow | 52/169.9 |
| 3,429,129 | A | * | 2/1969 | Johansson et al. | 52/741.14 |
| 3,664,082 | A | * | 5/1972 | Zintel | 52/742 |
| 3,789,559 | A | * | 2/1974 | Kirkes | 52/169 |
| 3,830,024 | A | | 8/1974 | Warnke | 52/23 |
| 3,831,329 | A | * | 8/1974 | Lear | 52/126 |
| 4,010,584 | A | | 3/1977 | Barnes, Jr. | 52/299 |
| 4,023,325 | A | * | 5/1977 | Paverman | 52/742 |
| 4,064,668 | A | | 12/1977 | Carter | 52/295 |
| 4,125,975 | A | * | 11/1978 | Soble | 52/126 |
| 4,170,853 | A | * | 10/1979 | Kohaut | 52/99 |
| 4,229,919 | A | * | 10/1980 | Hughes | 52/263 |
| 4,348,843 | A | | 9/1982 | Cairns et al. | 52/167 |
| 4,404,780 | A | | 9/1983 | Josephson | 52/126.7 |
| 4,434,600 | A | * | 3/1984 | Backman | 52/741 |
| 4,570,409 | A | * | 2/1986 | Wilks | 52/742 |
| 4,629,155 | A | * | 12/1986 | Dula | 249/61 |
| 4,738,061 | A | | 4/1988 | Herndon | 52/126.6 |
| 4,761,924 | A | | 8/1988 | Gustafson | 52/126.6 |
| 4,783,935 | A | * | 11/1988 | Creager | 52/98 |
| 4,866,797 | A | | 9/1989 | Vollan | 52/126.6 |
| 4,870,789 | A | | 10/1989 | Clark et al. | 52/126.6 |
| 4,882,887 | A | | 11/1989 | Giles et al. | 52/126.6 |
| 4,914,875 | A | | 4/1990 | Gustafson | 52/126.6 |
| 4,937,989 | A | * | 7/1990 | Miyares et al. | 52/126.7 |
| 4,952,135 | A | * | 8/1990 | Douglas | 425/543 |
| 4,976,077 | A | * | 12/1990 | Tucker | 52/126.6 |
| 5,152,108 | A | * | 10/1992 | Madl, Jr. | 52/126.1 |
| 5,175,973 | A | * | 1/1993 | Owen et al. | 52/742 |

(List continued on next page.)

FOREIGN PATENT DOCUMENTS

| | | | | |
|---|---|---|---|---|
| JP | 23242 | * | 2/1980 | 52/742 |
| JP | 106200 | * | 5/1987 | 52/741.13 |

*Primary Examiner*—Lanna Mai
*Assistant Examiner*—Phi Dieu Tran A
(74) *Attorney, Agent, or Firm*—Womble Carlyle Sandridge & Rice, PLLC; Lewis S. Rowell

(57) ABSTRACT

A method for preparing a footing for a foundation of the type for emplacement of a prefabricated building over a pattern of footing excavations, including suspending a block of rigid, but dissolvable material within each footing excavation with a prescribed distance between the lower end of the block and the bottom of the footing excavation, and pouring an unhardened load-bearing material around the sides of and under the block. When the load-bearing material has hardened, the block is dissolved so that the footing is ready to receive a vertical support stanchion.

11 Claims, 6 Drawing Sheets

U.S. PATENT DOCUMENTS 5,224,311 A 7/1993 Pearce ..... 52/169.9
5,363,610 A * 11/1994 Thomas et al. ..... 52/167
5,509,237 A * 4/1996 Coulter ..... 52/126.6
5,515,655 A * 5/1996 Hoffmann ..... 52/126.6
5,595,366 A 1/1997 Cusimano et al. ..... 248/354.3
5,697,191 A 12/1997 MacKarvich ..... 52/169.9
5,701,715 A 12/1997 Masters et al. ..... 52/698
5,778,625 A * 7/1998 Druffel et al. ..... 52/577
5,784,844 A * 7/1998 Mackarvich ..... 52/292
5,797,226 A * 8/1998 MacKarvich ..... 52/155
5,850,718 A 12/1998 MacKarvich ..... 52/292
5,862,635 A 1/1999 Linse et al. ..... 52/126.6
6,058,663 A 5/2000 MacKarvich ..... 52/167.3
6,193,209 B1 * 2/2001 Bergman ..... 249/65

* cited by examiner

METHOD AND SYSTEM FOR EMPLACING PREFABRICATED BUILDINGS

RELATED APPLICATIONS

This is a continuation-in-part of Ser. No. 09/710,778, filed Nov. 9, 2000, now U.S. Pat. No. 6,568,147 the content of which is incorporated herein in its entirety.

FIELD OF THE INVENTION

The present invention relates to a method for positioning and supporting mobile or modular building constructions. More particularly, the invention relates to a structural foundation system including multiple supporting stanchions, or support piers, permanently embedded in preformed, level, concrete footings.

BACKGROUND OF THE INVENTION

Numerous methods have been used in the past to place or position prefabricated mobile homes or other modular constructions on a prepared foundation, either temporary or permanent. Traditionally, "mobile" factory-built constructions have been merely placed on blocks, such as stacks of loosely placed concrete blocks. Since such supporting techniques involve no lateral support to resist loads such as wind or earthquake, various types of tie-downs or anchoring systems have been employed over the years.

As evidenced by damage statistics, prefabricated constructions suffer tremendous damage as a result of the overturning forces of high winds despite the fact that they have been tied down or anchored. Further, even when firmly installed, these conventional systems become loose over time due to repetitive tugging caused by the wind, and thus lose their effectiveness.

There are known in the art numerous more sophisticated support systems that have been conceived to address the above problems. However, these systems are quite expensive and labor intensive in their installation. For example, there are known supporting systems involving screw-jack arrangements, telescoping multi-sectional piers, or a combination of these in conjunction with shim plates for leveling. Additionally, the systems known in the art require elaborate footing schemes that include embedded anchor bolts, base plates, and rods. Despite the complex nature of these systems, properly leveling the mobile or modular constructions is tedious and often impossible since each of the supporting piers must be individually adjusted.

There has also been developed a system and method for emplacing prefabricated constructions that involves moving a mobile or modular construction in position over a plurality of footing excavations, leveling the mobile or modular construction, and placing an unhardened material, such as concrete, in each of the footings around stanchions that extend downwardly from the support frame of the mobile or modular construction into the footing excavations. See my parent application Ser. No. 09/710,778. While this construction system is highly effective, implementation can be difficult. That is, the movement of a mobile or modular construction over a plurality of excavation footings can be tedious, time-consuming, and even dangerous, for if a wheel of the transport vehicle were to run into one of the footing excavations, the structure could become unstable and overturn. Personal injury, or death, of the installation personnel could also result.

SUMMARY OF THE INVENTION

The present invention relates to a unique method of constructing a foundation system for supporting mobile or modular constructions that is cost effective, easily and accurately installed, and that will better withstand the forces of nature. More particularly, the method of the present invention facilitates the efficient and safe movement of a mobile or modular construction over the foundation on which the construction will be supported. As used herein, "prefabricated constructions" means structures, in whole or in part, that are pre-manufactured or prefabricated before being moved to the site of installation. Such structures include, but are not limited to, mobile homes, doublewide homes, manufactured housing, and commercial structures such as modular office spaces and classrooms. According to the method of the present invention, a pattern of footing excavations conforming to the support frame system of the mobile or modular construction is first dug. The overall dimensions of the excavations are determined by the bearing strength of the soil. A block of foam is next suspended in each of the excavations. The foam block is dimensioned so that its horizontal cross section is slightly larger than the horizontal cross-section of the stanchion that it will support. The height of the foam block is less than the depth of the footing excavation so that concrete will fill the volume below the block. Each foam block is suspended in the excavation with wires or small rods so that it will remain firmly in place during formation of the concrete footing. The foam blocks are dimensioned and suspended such that a specific depth of concrete will settle beneath each foam block. As will be appreciated, each excavation and foam block is surveyed so that the upper surfaces of the series of foam blocks are at the same elevation. This ensures that the mobile or modular construction will be level when installed without the need for additional, and tedious, leveling steps.

Once the foam blocks have been properly positioned, concrete, or other suitable unhardened load-bearing material, is poured into each excavation until the load-bearing material is even with the surface of each foam block. Since the foam blocks are initially suspended in the excavations, a desired level, e.g., about 6 inches of unhardened concrete will fill in below each foam block. For typical concrete mixtures, a curing time of approximately 7 days is required.

After the concrete has cured to the desired hardness, the blocks of foam are removed. As those skilled in the art will appreciate, removing a solid object that is surrounded by concrete is typically quite difficult, if not impossible. It has been found, however, that forming the blocks of a foam material solves this problem. Because typical foams are dissolved, or melted, when contacted by organic liquids or hydrocarbon solvents, such as gasoline and the like, a small quantity of such a liquid is poured onto the foam. As a result, the foam essentially dissolves, leaving an open volume the size of the original foam block, and without adversely affecting the quality of the concrete.

The mobile or modular structure is next moved into position over the prepared footings. Since the size of the openings in each footing, e.g., about 5 inches by about 7 inches, are small compared to the wheels of a conventional transport vehicle, the transport vehicle and mobile or modular structure can drive over the footings without danger of personal injury, equipment damage, or fear of damaging the footings. The present invention is used with a support system for mobile or modular constructions of the type having two or more longitudinally extending support frame members thereunder. Once the structure is in position and lifted, or jacked up, vertical stanchions are attached to the support frame members of the structure at spaced points corresponding to the previously prepared footings.

The order of certain steps of this method is not critical. For example, the mobile or modular construction may be initially moved into position over a plurality of footings, prepared as described above, and then jacked up. Stanchions are then attached to the supporting structure of the mobile or modular construction. Alternatively, the stanchions may be attached to the support members prior to moving the jacked up mobile or modular construction into position. In either case, the upper portions of the stanchions are attached to the support members of the mobile or modular structure using angles or other suitable fasteners. The mobile or modular construction is positioned over the prepared footings so that the footings are in substantial alignment with the support members of the mobile or modular structure. When all of the stanchions are attached, the mobile or modular construction is lowered so that the stanchions are resting in and supported by slots in the concrete footings. Where additional lateral support is desired, one or more cross braces may be attached between selected pairs of stanchions to provide an additional level of restraint against horizontal forces, such as wind.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
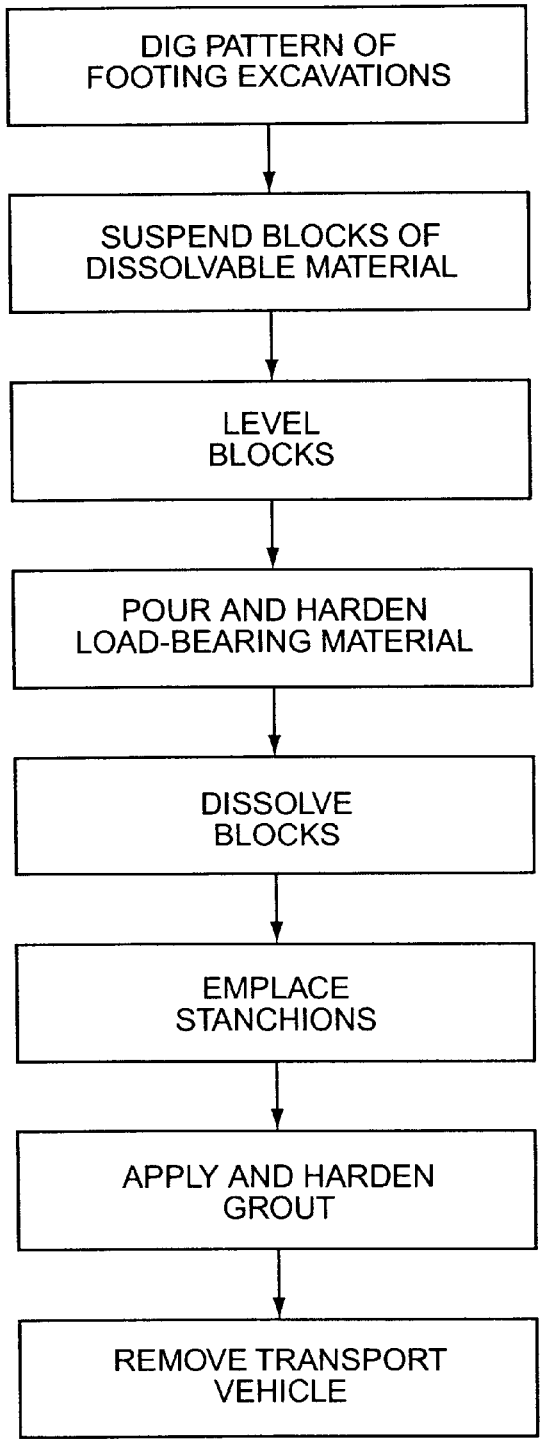
FIG. 1 is a flow diagram of the method of the present invention.

The present invention is directed to a method for permanently supporting a mobile or modular construction. FIG. 1 is a simplified flow diagram of the method of the present invention.

Figure 2:
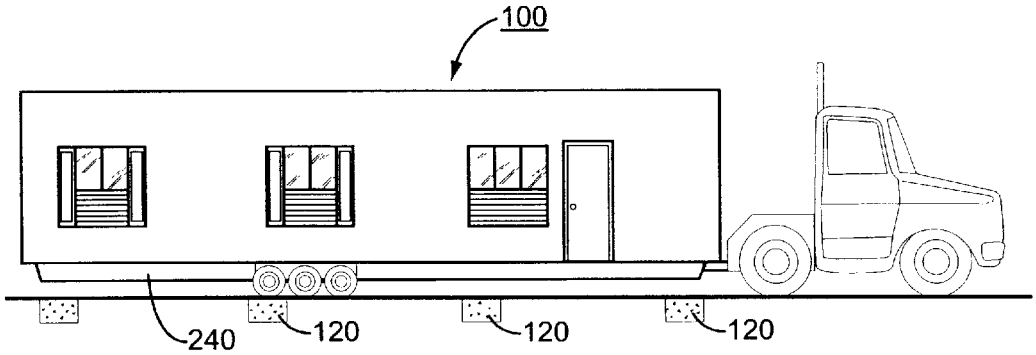
FIG. 2 is a schematic of a mobile construction being moved into place over prepared excavated footings.

As illustrated schematically in FIG. 2, mobile or modular constructions 100, whether for residential or commercial use, are normally pre-manufactured and transported intact to the buyer's property where they are made ready for habitation. At the buyer's location, the mobile or modular construction must be placed upon some form of foundational support, typically involving supporting the construction on level footings with blocks, jacks or the like. The present invention is not intended to change the mode of transporting the construction to its destination, but rather to introduce a superior foundation system and more efficient method for emplacing the construction 100 when it arrives at its destination.

Figure 3:
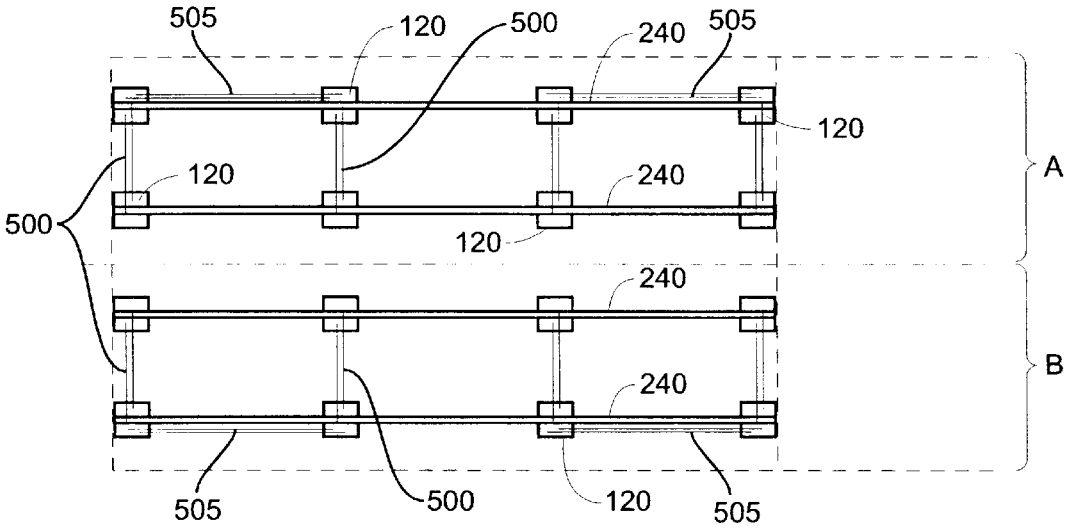
FIG. 3 is a schematic illustrating the general alignment of mobile or modular construction support members over excavated footings.

As shown in FIGS. 2 and 3, when a mobile or modular construction 100 is positioned for installation, it is typically oriented so that the underlying support frame members 240 of the construction are generally aligned with footings or proposed footings 120. FIG. 3 is illustrative of the support arrangement for a doublewide type construction where the construction consists of two sections, A and B, that are mated together at the installation site. Each section A and B normally has two support frame members 240 provided thereunder. Support members used in the industry are generally I-beams; however, tubular support members and box-like beams are also known. Thus, for a doublewide construction, there are usually four support members 240. A conventional mobile home, on the other hand, would be represented by either A or B, with two underlying support members 240. As also shown in FIG. 3, there are typically four spaced footings 120 for each support member 240. As will be appreciated, when the spaced footings are open excavations, moving the mobile or modular construction into place is both tedious and dangerous.

Figure 4:
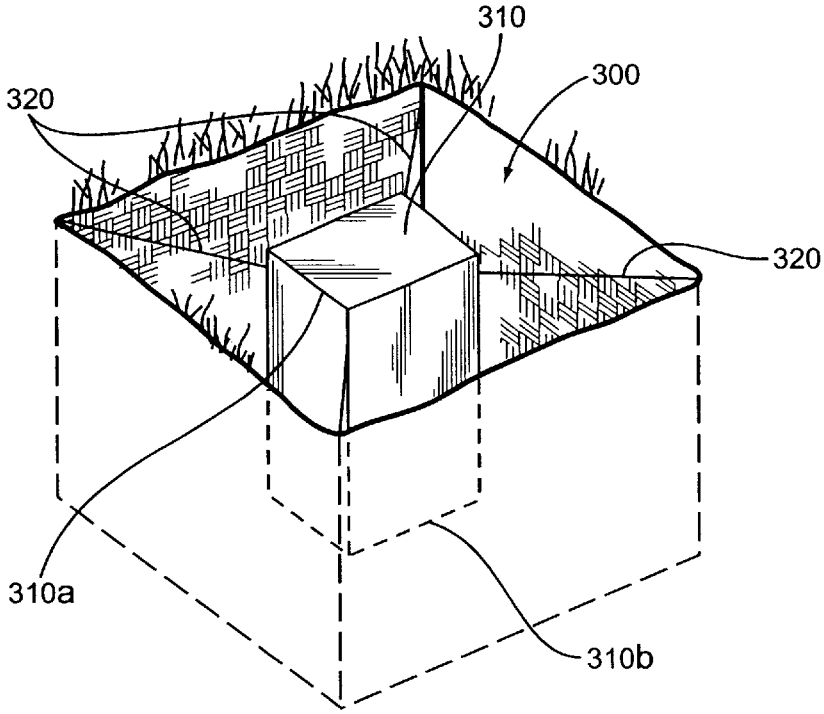
FIG. 4 is a perspective view of a foam block of the present invention suspended in a footing excavation.
Figure 5:
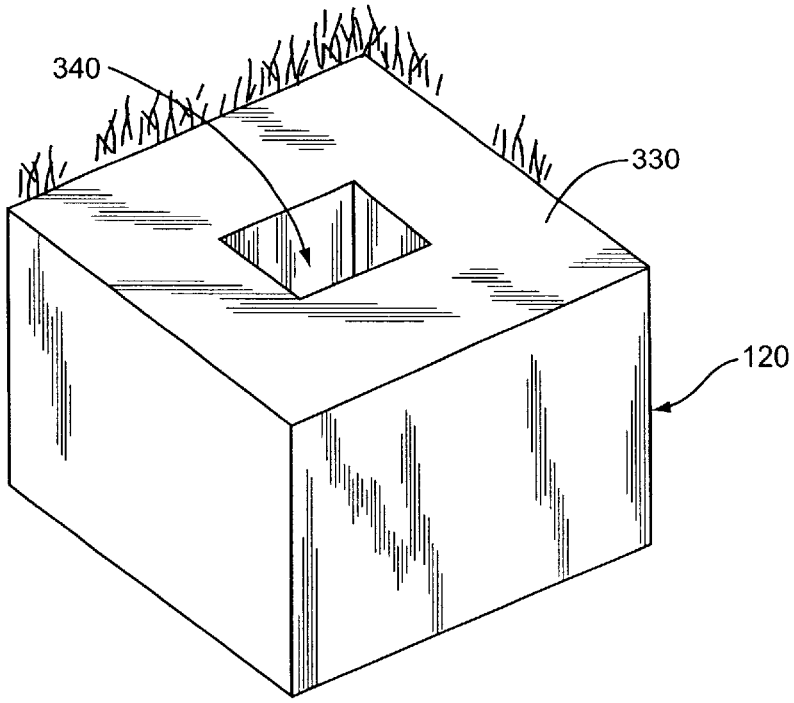
FIG. 5 is an perspective view of a footing constructed according to the present invention.

One aspect of the present invention is a method for constructing footings for supporting mobile or modular constructions 100 as described hereinabove. Turning to FIGS. 4 and 5, the method will be described in detail. The first step, of course, is to dig the footings required to provide adequate support for the mobile or modular construction. Footing excavations 300 are conventional and well known in the art, especially in traditional residential and commercial construction. The dimensions for each of the plurality of prepared footings are generally the same and are dictated by the bearing strength of the underlying soil. For example, for soil with a bearing strength of 2,000 pounds per square foot, the concrete footing shall be approximately 2.67 feet wide, 2.67 feet long, with a minimum depth of 2 feet. Alternatively, the footings could be about 3 feet in diameter, with a minimum depth of 2 feet. The method of the present invention is, therefore, not restricted to particular dimensions or geometry. Rather, the overall dimensions and geometry of the footings described herein are exemplary.

Once the footing excavations have been dug, a block of dissolvable material 310 is suspended in the center of each footing. In a preferred embodiment, the dissolvable material is a foam, although other dissolvable material types may well be suited for the method of the present invention. The block of foam material 310 is Styrofoam®, polystyrene, or other suitable polymerized styrene that is easily attacked and dissolved by hydrocarbon solvents such as gasoline or petroleum products, as will be discussed in more detail below. The block of foam 310 is dimensioned to have a horizontal cross section of approximately 5 inches by 7 inches, and to be about 18 inches deep. These dimensions are selected based on the size of the stanchion that will ultimately be supported in the prepared footing. As will be appreciated, these dimensions are exemplary and subject to change, depending upon the particular installation, as well as the type and size of stanchion used. For a footing dimensioned as described above, this means that the stanchion will be embedded 18 inches, and will rest on a minimum of about 6 inches of concrete. Each block of foam 310 is suspended by one or more holders 320, such as wires or rods, or other suitable lengths of material, so that each is held firmly in place during the subsequent placement of a load-bearing material. The manner in which the block of foam 310 is suspended is not critical to the present invention, so long as the manner of suspension does not interfere with the subsequent construction of the footing. For instance, holders 320 may be oriented parallel to the sides of the excavation and the block of foam 310, or may be oriented in any other angle. In its simplest construction, holders 320 are long enough to bridge the open excavation 300. Alternatively, wires or small posts could be oriented directly upward from the bottom of the excavation into the bottom of the block of foam 310 to hold it firmly in place.

As will be appreciated by those skilled in the art, and as is conventional in the building industry, each footing is surveyed to ensure that the top surface of each footing is at the same elevation as all of the other footings. In the present invention, the suspended blocks of foam 310 are surveyed to ensure that their upper surfaces 310*a* are at the same elevation. Because the blocks 310 are all similarly dimensioned, and their ends square, the bottom surfaces 310*b* will also be at the same elevation. Appropriate adjustments are made on a footing by footing basis to correct any differences. As will also be appreciated, when the mobile or modular construction is to be situated on sloping or unlevel terrain, the tops of the footings may be at different relative elevations, so long as the stanchions placed therein are dimensioned to compensate for the differences in elevations of the footings. This concept is well known in the construction art and a routine technique of those skilled in the art.

With the blocks of foam 310 suspended and surveyed, the next step is to pour an unhardened load-bearing material 330 into the excavation until it completely fills under and around each foam block 310 and is substantially level with the top 310*a* of the foam block 310. One well-known and suitable load-bearing material is concrete. Concrete is easily poured into footing excavations and tamped down as needed to ensure that it fills in the volume beneath the bottom 310*b* of the block of foam 310. The concrete should be allowed to cure to a load bearing strength of about 3,000 pounds per square inch. This typically takes about 7 days.

When the concrete has cured, the blocks of foam 310 must each be removed to create a slot, or opening, 340 in each concrete footing 120 for the subsequent placement of a stanchion from the mobile or modular support system. It will be appreciated that removal of materials or forms embedded in hardened concrete is often impossible, or done only with resulting damage to the concrete. That is the very reason why concrete is the material of choice for embedding fixtures such as posts, poles, supports, and the like, as they are rigidly supported and are not easily loosened. It has been found, however, that using foam to form the slots 340 of the present invention provides a simple and economical solution and method of construction. First, while lightweight and easy to handle, it can easily be cut or formed into rigid blocks of a desired size. These rigid blocks of foam will not distort or crush under the load or pressure of poured concrete, thus making ideal molds for the formation of consistently dimensioned slots. After the concrete is cured, it has been found that the foam is easily removed. Because polymerized styrene is susceptible to attack by and will dissolve or "melt" when exposed to hydrocarbon solvents, several drops of a petroleum-based solvent, such as gasoline, will dissolve the blocks of foam 310 within a few seconds, without harming the surrounding concrete. Any residue is easily cleaned out of the slot 340 with the same solvent. When complete, a finished footing 120, such as that shown in FIG. 5, is ready to accept the mobile or modular construction 100 support system.

Because the top surface 310*a* of each block of foam 310 has been surveyed, and since each of the blocks of foam 310 is identically dimensioned, the bottom of each slot will be at the same elevation as well. Thus, as will be better understood from the following description of the mobile or modular construction 100 support system, the separate, tedious, and time-consuming process of first leveling the construction 100 over the plurality of footings 120 is eliminated.

The horizontal cross section of each slot 340 is dimensioned large enough, e.g., 5 inches by 7 inches to facilitate insertion of a steel stanchion, e.g., 3 inches by 3 inches square, while being dimensioned small enough in overall cross section to provide sufficient support to the stanchion. This horizontal cross section for a 3 inch square stanchion facilitates a simple and efficient installation. That is, the size and mass of the concrete footing 120, with the slot 340 formed therein, is alone adequate permanent support for a stanchion.

Figure 6:
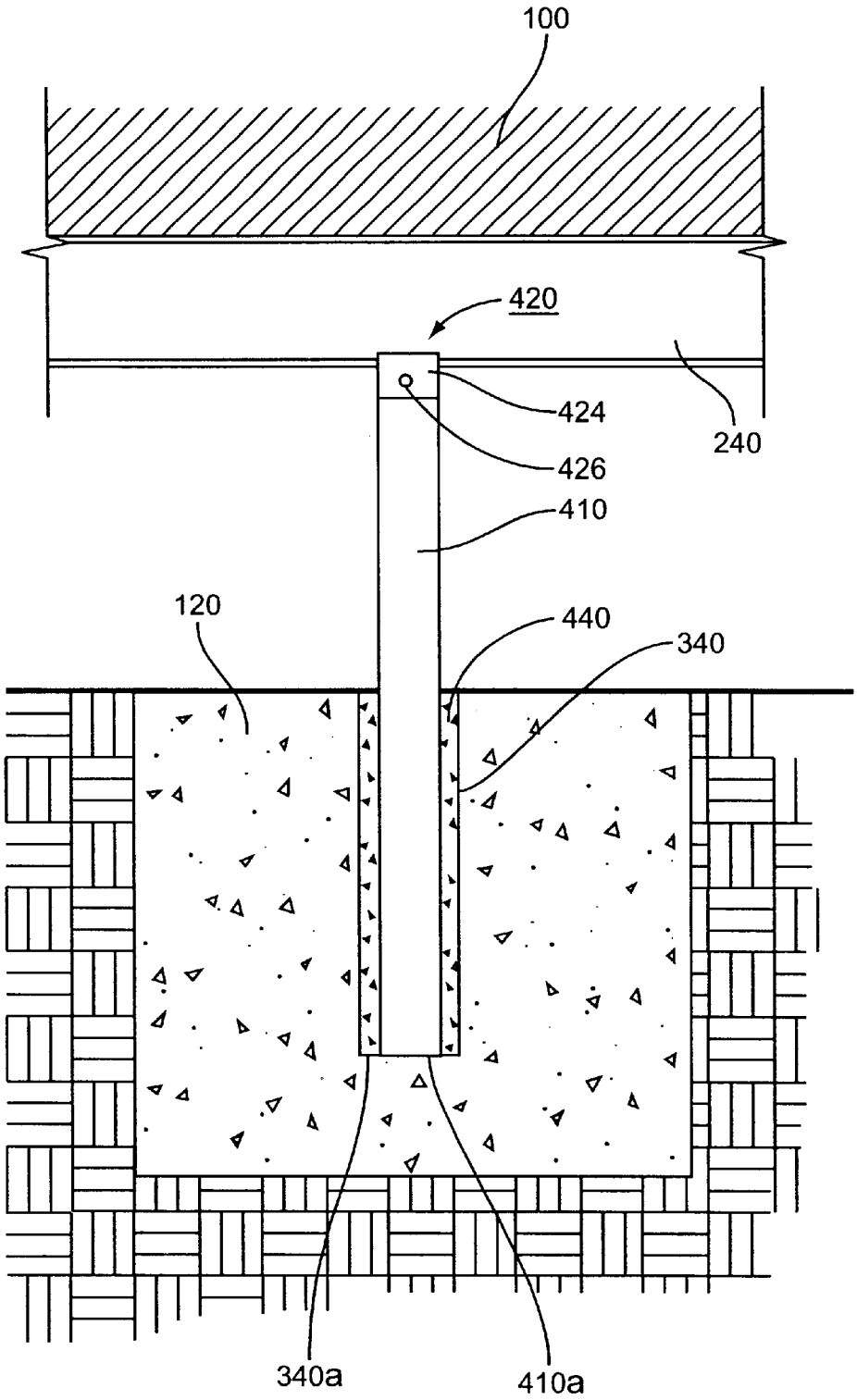
FIG. 6 is a side view of a footing constructed according to the present invention.
Figure 7:
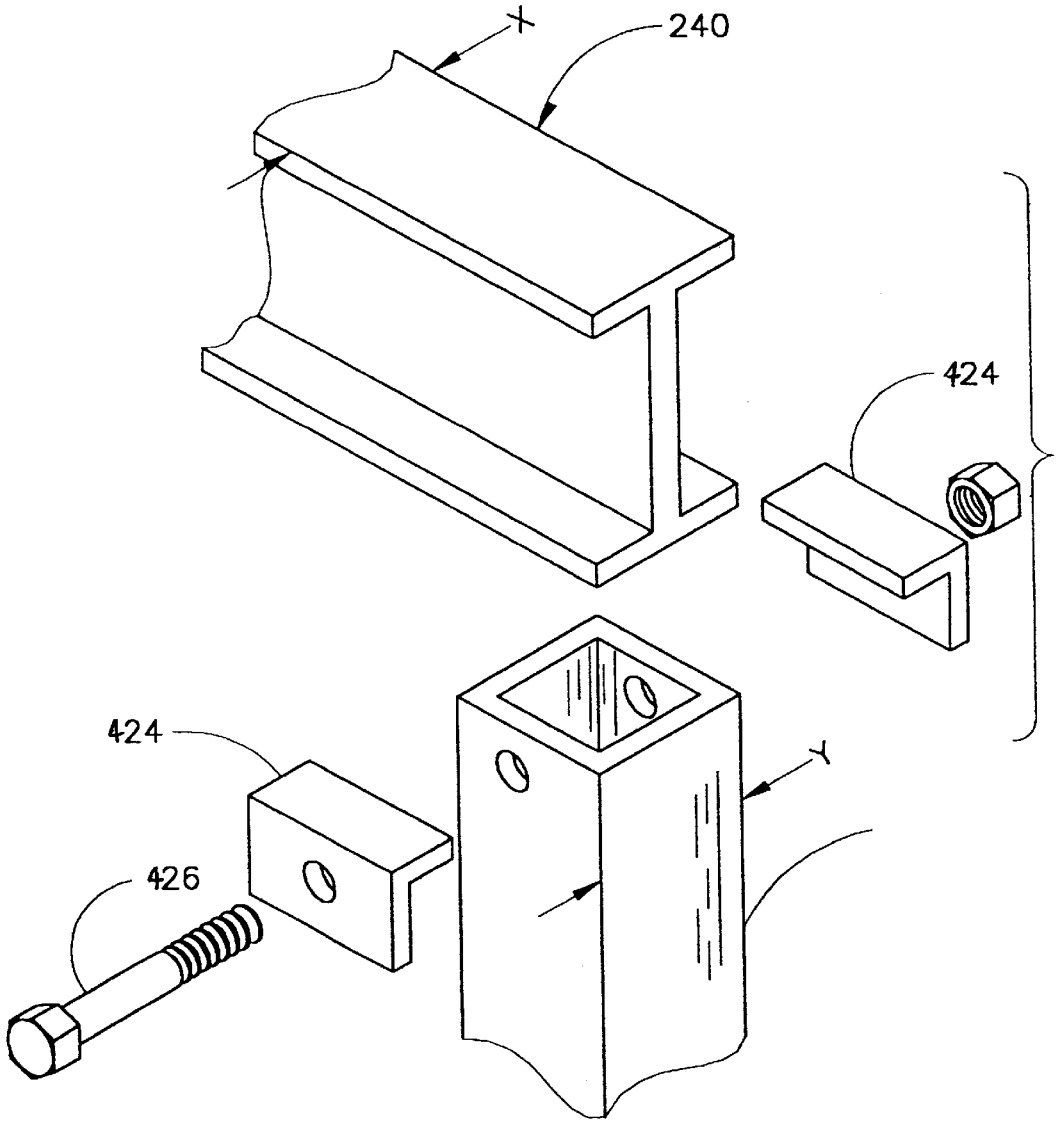
FIG. 7 is an exploded view of the stanchion support system of the present invention.

FIGS. 6 and 7 illustrate how each stanchion 410 is rigidly fastened to a support frame member 240. As shown in FIG. 7, stanchions, or piers, 410 are formed as a single piece from a suitable tubular steel stock. In one embodiment, the tubular steel stock is Grade A50 steel. The stanchions may be transported separately, or could be hingedly attached to supports 240, so that upon positioning, they could be rotated into position and rigidly secured. Dependent upon the contour of the ground, stanchions 410 may vary in length up to a maximum clear height. As used herein, "maximum clear height" refers to the vertical distance between the bottom of support member 240 and the top of footing 120, as permitted by local building codes. While Grade A50 steel is preferred, lesser grades, down to and including Grade A36 are also suitable for the present invention. Likewise, structurally equivalent shapes other than square tubes may be used; however, suitable tubular steel is well known and conventional. The cross section of the stanchions 410 chosen for the foundation system is governed by the flange width (x) of the support member 240 (I-beam). For a support member flange with a width (x) of 3 inches, a square tube with a 3×3×¼ cross-section is used. For a flange width (x) of 4 inches, a 4×4×3/16 inch tube is used. Thus, preferably the side width (y) of stanchion 410 will equal the flange width (x) of support member 240. Since stanchions 410 will typically be cut from square tube stock, the upper end of the tubes should be squarely cut to ensure uniform and continuous contact between stanchions 410 and support 240.

As illustrated in FIG. 7 fasteners 420 are provided for connecting the upper portion of stanchion 410 to support members 240. Fasteners 420 comprise a pair of right angles 424 and bolt 426. While the fasteners illustrated in FIG. 6 are used for connecting the present invention to conventional I-beam support members 240, other conventional fasteners known in the art for connecting structural steel will be used for tubular or box beam type support members. For I-beams with 4-inch flanges, L 1¾×2×¼ inch right angles are used, and for 3-inch flanges, L 1¾×2×¼ inch right angles are used. As will be appreciated by those skilled in the art, the horizontal and vertical dimensions of the right angles are not critical and, as such, a range of sizes may be suitably used. Likewise, where I-beams are used with smaller or greater flange widths than those described herein, the sizes of the fasteners used will of necessity vary. Angles 324 are formed from at least Grade A36 steel. For I-beam arrangements such as that shown in FIG. 7, an angle 424 is placed on either side of stanchion 410 so that each angle overlaps one side of the flange of the I-beam 240. Bolt 426 is inserted through holes or slots formed through the stanchion 410 and angles 424 to securely connect stanchion 410 to support member 240.

The order of certain steps of the method described herein is not critical to the satisfactory accomplishment of emplacing a mobile or modular construction 100. Specifically, and again referring to FIGS. 2 and 3, the mobile or modular construction 100 may be initially moved into position over the prepared footings 120 wherein stanchions 410 are then attached to supporting members 240 of the mobile or modular construction 100. Alternatively, stanchions 410 may be attached to support members 240 prior to moving the construction 100 to its destination. In the latter case, stanchions 410 are configured so that they are stored in a position amenable to transport. In either case, the upper portions of stanchions 410 are attached to the support members 240 using the fasteners described hereinabove and the construction 100 is positioned over footings 120 such that the stanchions 410 are vertically oriented over footings 120.

Once the stanchions 410 have been attached to supporting members 240 and properly aligned over footings 120 described hereinabove, the mobile or modular structure 100 is lowered until the base 410*a* of each stanchion is resting on the lower surface 340*a* of each slot 340. As shown in FIGS. 5 and 6, the relative position of a stanchion from end and side views is shown. As will be appreciated by those in the civil and structural engineering arts, the static load of the mobile or modular structure 100 is now stably supported by the combination stanchion 410 and footing 120 foundation, without the requirement for further forms of reinforcement. Desirably, however, an unhardened load-bearing concrete or grout 440 is poured into the open slot 340 around the stanchion 410 and allowed to cure, more permanently anchoring the stanchion within the footing 120. Alternatively, a loose filling material, such as rock or gravel, could be placed in the open slot 340 to provide permanent support.

Figure 8:
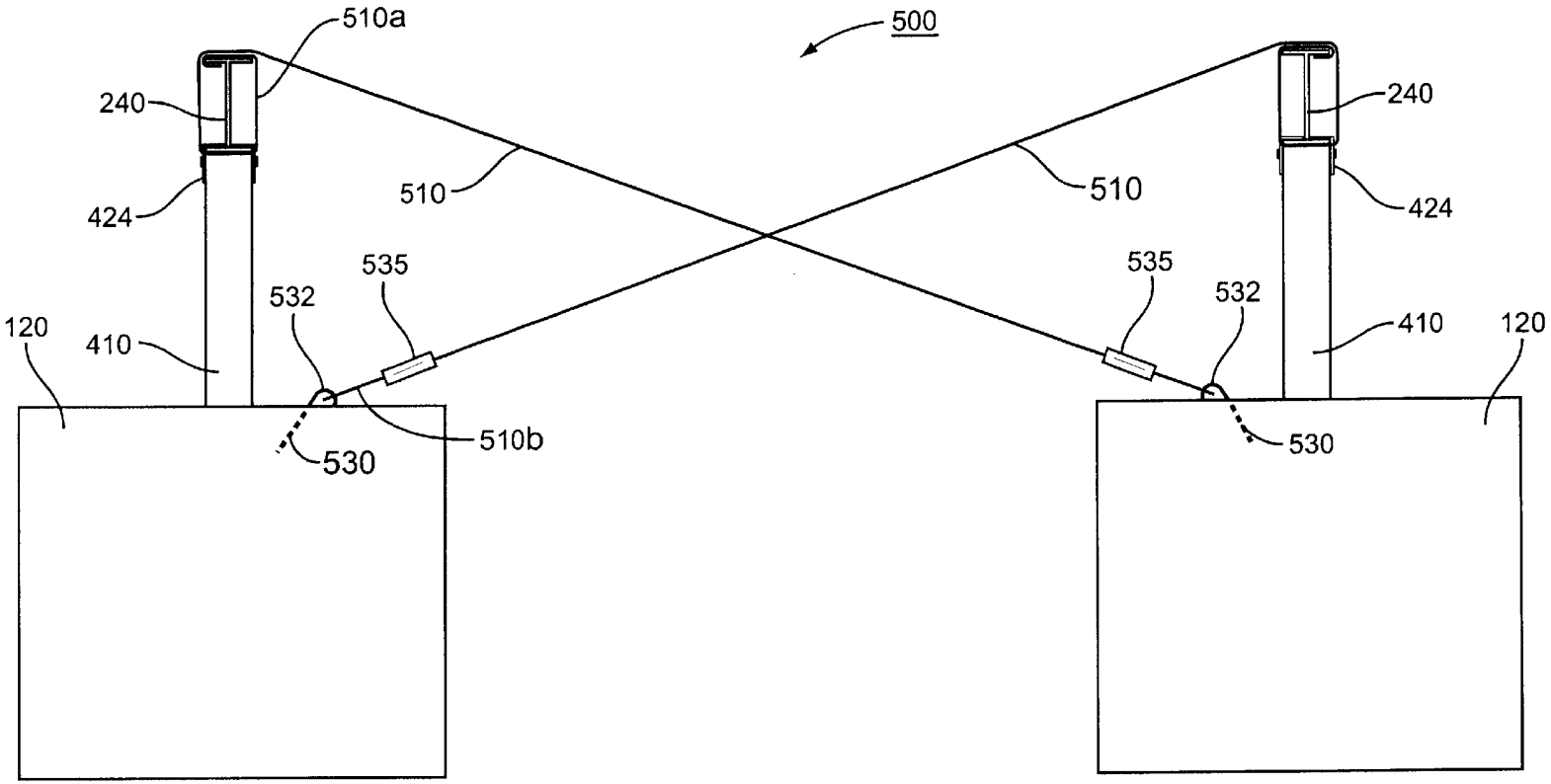
FIG. 8 is a end view of the cable system of the present invention.

A further aspect of the present invention is to provide a supplemental support system 500 between selected pairs of supported stanchions. When the exemplary supplemental support system 500 is combined with the stanchion support system described above, a supported mobile or modular construction is capable of withstanding significant lateral forces, such as anticipated horizontal, or shear, winds. While cross-bracing systems are generally known in the art, they have not heretofore been an integral part of a stanchion, or footing, support system for a mobile or modular construction. The cross-bracing arrangement 500 of the present invention is best seen in FIG. 8, and exemplary locations for the cross-bracing 500 are best seen in FIG. 3. While more or fewer cross-braces may be installed, depending upon the design considerations for vertical and horizontal loading, the arrangement shown in FIG. 8 is exemplary.

Each cross-bracing construction 500 is comprised of a cable or rod 510, extending from a longitudinal I-beam 240 to an anchor point 530 formed in an opposed footing 120. The cables in one embodiment are ⅜ inch diameter and formed of galvanized steel. One end 510*a* of the cable is clamped with a conventional clamping device (not shown) to the lower portion of the I-beam support frame member 240. The cable 510 is then wrapped at least one complete turn around the cross section of the I-beam 240. There are a number of other ways that the cable 510 could be attached to the support frame member 240. For example, one end of cable 510 could be inserted through an aperture in the I-beam and fastened with any conventional fastener adapted to small diameter cables. The opposite end 510*b* of the cable 510 is attached to an anchor point 530, comprising a structural hook or reinforcing bar 532 that has been partially embedded in the concrete footing 120. Alternatively, a threaded or unthreaded steel rod could be used in lieu of a cable and inserted through apertures formed through the stanchions and plates or the like at the anchor points. The ends of the steel rods could be firmly secured with conventional fasteners, such as threaded nuts.

While an extensive list of examples could be provided herein for sizes, shapes, and relative locations for anchor devices, such selections are well within the skill of those in the structural and civil engineering arts. Positioned between the two ends of the cable 510 is a tightening device 535, such as a turnbuckle, for tightening each cable 510 of the pair, after the cables are attached at the anchor points 530 and the I-beams 240. The provision of the tightening devices permits the installer to "square" the installation. Alternately, cables 510 could be attached directly to the vertical stanchions where additional support between stanchions is desired in the longitudinal direction. For example, supplemental longitudinal supports 505 may be installed as shown in FIG. 3 at the corners of the mobile or modular construction 100.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

I claim:

1. A method for emplacing a prefabricated building of the type having two or more support frame members provided thereunder and a plurality of vertical support stanchions attached to the support frame members, said prefabricated building being emplaced over a pattern of footing excavations, comprising:

(a) suspending a block of rigid, but dissolvable material within each of the plurality of footing excavations so that each of the blocks has a lower end at substantially the same elevation and a prescribed distance between the lower end and the bottom surface of the footing excavation;

(b) pouring an unhardened load-bearing material around the sides of and under each of said blocks in each of the footing excavations;

(c) when the load-bearing material has hardened, dissolving the blocks to form slots therein, the slots having open upper ends and lower ends of hardened load-bearing material, wherein each of the plurality of footings is ready to receive a vertical support stanchion; and (d) lowering the prefabricated building until the plurality of vertical support stanchions are resting in each of the slots in the plurality of footings.

2. The method of claim 1 wherein said block has cross-sectional dimensions at least as great as the corresponding dimensions of the vertical support stanchion.

3. The method of claim 1 wherein the prescribed distance between the lower end of the block and the bottom of the footing excavation is at least about 6 inches.

4. The method of claim 1 wherein the blocks are suspended within the plurality of footing excavation by holders, the holders extending across the top of each footing excavation.

5. The method of claim 1 wherein the blocks are polymerized styrene.

6. The method of claim 5 wherein each of the blocks is dissolved with a hydrocarbon solvent.

7. The method of claim 1 further including the additional step of placing additional load bearing material in each slot around each stanchion.

8. The method of claim 1 further including the additional step of connecting bracing between selected pairs of vertical support stanchions so that the prefabricated building is capable of withstanding horizontal forces.

9. The method of claim 8 wherein the step of connecting bracing between selected pairs of stanchions comprises:

(a) attaching a first brace between the upper end of a first connected stanchion and the footing of a second connected stanchion; and (b) attaching a second brace between the upper end of the second connected stanchion and the footing of the first connected stanchion.

10. The method of claim 8 wherein the step of connecting bracing between selected pairs of stanchions comprises:

(a) attaching a first brace between a first support frame member of a first connected stanchion and the footing of a second connected stanchion; and (b) attaching a second brace between a second support frame member of the second connected stanchion and the footing of the first connected stanchion.

11. The method of claim 8 wherein the step of connecting bracing between selected pairs of stanchions comprises:

(a) attaching a first brace between the upper end of a first connected stanchion and the lower end of a second connected stanchion; and (b) attaching a second brace between the upper end of the second connected stanchion and the lower end of the first connected stanchion.

* * * * *